US007501958B2

(12) United States Patent
Saltzstein et al.

(10) Patent No.: US 7,501,958 B2
(45) Date of Patent: Mar. 10, 2009

(54) STROBE LIGHT ALARM DETECTION AND ALERT SYSTEM

(75) Inventors: William Saltzstein, Woodinville, WA (US); David E. Albert, Oklahoma City, OK (US)

(73) Assignee: InnovAlarm Corporation, Oklahoma, OK (US)

( * ) Notice: Subject to any disclaimer, the term of this patent is extended or adjusted under 35 U.S.C. 154(b) by 0 days.

(21) Appl. No.: 11/776,453

(22) Filed: Jul. 11, 2007

(65) Prior Publication Data

US 2008/0012716 A1 Jan. 17, 2008

Related U.S. Application Data

(60) Provisional application No. 60/807,093, filed on Jul. 12, 2006.

(51) Int. Cl.
*G08B 17/12* (2006.01)

(52) U.S. Cl. ..... 340/600; 340/407.1; 340/691.1; 340/693.5

(58) Field of Classification Search ..... 340/573.1, 340/328, 407.1, 539.11, 540, 600, 691.1, 340/693.5

See application file for complete search history.

(56) References Cited

U.S. PATENT DOCUMENTS 4,090,185 A * 5/1978 Patty ..... 340/321
4,853,674 A * 8/1989 Kiss ..... 340/407.1
5,278,539 A * 1/1994 Lauterbach et al. .... 340/539.18
5,751,210 A * 5/1998 Kosich ..... 340/326
5,790,050 A * 8/1998 Parker ..... 340/902
6,215,404 B1 4/2001 Morales
6,380,854 B1 * 4/2002 Hagerman et al. ..... 340/540
6,658,123 B1 12/2003 Crutcher
7,148,797 B2 12/2006 Albert
7,173,525 B2 2/2007 Albert
2004/0135699 A1 * 7/2004 Salzhauer et al. ..... 340/691.1
2004/0145467 A1 7/2004 Roby et al.
2004/0179694 A1 * 9/2004 Alley ..... 381/55
2006/0123053 A1 * 6/2006 Scannell ..... 707/104.1
2006/0250260 A1 11/2006 Albert et al.
2007/0096927 A1 5/2007 Albert

OTHER PUBLICATIONS

Gwynne, Steven, M.V., Ph.D., Optimizing Fire Alarm Notification for High Risk Groups Research Project, "Summary report," pp. 1-127, Prepared for The Fire Protection Research Foundation. (Jun. 2007).

Bruck, Dorothy and Thomas, Ian, Optimizing Fire Alarm Notification for High Risk Groups Research Project, "Waking effectiveness of alarms (auditory, visual and tactile) for adults who are hard of hearing," School of Psychology, Centre for Environmental Safety and Risk Engineering (CESARE), Victoria University, Australia, pp. 1-100, Prepared for The Fire Protection Research Foundation. (Jun. 2007).

(Continued)

*Primary Examiner*—Thomas J Mullen
(74) *Attorney, Agent, or Firm*—Knobbe, Martens, Olson & Bear LLP

(57) ABSTRACT

A system is disclosed that detects an optical alarm signal, such as a strobe light signal generated by a building alarm system. Upon detecting such a signal, the system generates a supplemental alert signal capable of alerting an individual who might not otherwise respond to the alarm condition, such as an individual who is asleep, hearing impaired, and/or sight impaired. The system may, for example, be implemented as a patient-worn device, a bedside unit, or a personal computer coupled to a light-sensing peripheral device.

31 Claims, 5 Drawing Sheets

OTHER PUBLICATIONS

Bruck, Dorothy, Thomas, Ian and Ball, Michelle, Optimizing Fire Alarm Notification for High Risk Groups Research Project, "Waking effectiveness of alarms (auditory, visual and tactile) for the alcohol impaired," School of Psychology, Centre for Environmental Safety and Risk Engineering (CESARE), Victoria University, Australia, pp. 1-73, Prepared for The Fire Protection Research Foundation. (Jun. 2007).

Du Bois, Jacqueline, Ashley, Erin, Klassen, Michael and Roby, Richard, "Waking Effectiveness of Audible, Visual and Vibratory Emergency Alarms on People of all Hearing Abilities," Combustion Science & Engineering, pp. 1-4, posted on Gallaudet University's web site, (undated).

Bruck, Dorothy and Thomas, Ian, "Reducing fire deaths in the aged: optimising the smoke alarm signal," School of Psychology & Centre for Environmental Safety and Risk Engineering, pp. 1-39, NFPA sponsored research from Victoria Univeristy, NFPA proceedings, (2006).

Research report, "Emergency Signaling Devices for Use by The Hearing Impaired," Underwriters Laboratories, Inc., pp. 1-89, Subject 1971, US 187 89K2052, National Electrical Manufacturers Association, dated Mar. 20, 1991.

* cited by examiner

STROBE LIGHT ALARM DETECTION AND ALERT SYSTEM

PRIORITY CLAIM

This application claims the benefit of U.S. Provisional Application No. 60/807,093, filed Jul. 12, 2006, the disclosure of which is hereby incorporated by reference.

TECHNICAL FIELD

The present invention relates to alarm systems that indicate smoke, fire, carbon monoxide, and/or other conditions, most particularly those used for hearing impaired individuals that involve strobe lights mandated by building codes for public places and those used in private homes.

BACKGROUND

The presence of smoke, fire, hazardous carbon monoxide concentrations are commonly sensed in commercially available products using several types of technologies. These products traditionally alert the occupants using loud audible alarms of loud tones which do not alert many individuals with hearing impairments. Building and fire regulations recognize this issue and mandate that public structures and rooms include bright flashing lights, also called 'strobes', to alert those individuals with impairments.

Regulations exist that require strobes to be mounted where they will illuminate appropriate areas such that individuals will see these lights and be able to take appropriate actions. One such regulation is included in UnderWriters Laboratory code 1971 (UL 1971, "Signaling Devices for the Hearing Impaired", ISBN 0-7629-0790-8), which requires the strobes to have a designated intensity and to flash from 60 to 120 times per minute.

Other devices designed specifically for hearing impaired individuals alert them to conditions such as ringing telephones, intrusion alarms, doorbells, and other conditions requiring attention via visual indication with strobe lights. For examples of such devices, see the following URLs:

http://www.krownmfg.com/html/products/signal_device-.html http://www.kidde.com/utcfs/Templates/Pages/Template-53/0,8062,pageId%3D4496%26siteId%3D384,00.html Some manufacturers sell stand-alone products that have combined smoke detection and strobe signaling into one self-contained device. These products include the Model 710 series devices from Gentex Corporation (www.gentex.com/fire_photo_pd4.html), and the First Alert Model SA100B from BRK Brands.

These devices have been shown to be quite effective to awaken and alert hearing impaired individuals, but quite ineffective when they are asleep. See Erin Ashley et al., "Waking Effectiveness of Audible, Visual, and Vibratory Emergency Alarms across all Hearing Levels," published by Combustion Science & Engineering, Inc. Strobes are completely ineffective when hearing deficits are combined with visual deficits. If the individuals are not alerted, the results can range from inconvenient to deadly.

Current state of the art, exemplified in FIG. 1, addresses these deficiencies with technology designed to interconnect via wired or wireless connections 10 to the detection devices and alarms. These methods also include technology, exemplified in FIG. 2, to 'listen' for smoke detectors and translate those sounds into lower frequencies more likely to alert those with less severe impairments. One such technology is described in U.S. Pat. No. 6,658,123 to Crutcher.

SUMMARY OF THE DISCLOSURE

A system is disclosed that detects an optical alarm signal, such as a strobe light signal generated by a building alarm system. Upon detecting such a signal, the system generates a supplemental alert signal capable of alerting an individual who might not otherwise respond to the alarm condition, such as an individual who is asleep, hearing impaired, and/or sight impaired. The system may, for example, be implemented as a patient-worn device, a bedside unit, or a personal computer coupled to a light-sensing peripheral device.

DETAILED DESCRIPTION OF THE PREFERRED EMBODIMENTS

While the current solutions are certainly helpful in many situations, they do not protect individuals in many sleeping situations, and are not easily adaptable for travel or sleep away from the specialized equipment. These devices are often prohibitively expensive to many in need, due to their specialized nature, high component count, and low production volumes. In addition, many impairments and sleep situations make them ineffective.

Millions of public and private buildings including hospitals, hotels, and private homes have installed the strobe alerting devices that are not effective at awakening at-risk populations (such as the hearing impaired). As studies are introduced showing alarm methods with greater effectiveness (Bruck, NFPA Conference, Jun. 3, 2007: "Waking effectiveness of auditory, visual and tactile alarms"), there is a need for a solution that can 'retrofit' those installations without total replacement of the system or its components. There is also a need for technologies that can be produced with small size and affordable cost to meet the needs of the at-risk populations.

The present invention comprises an alert system that detects strobe light patterns produced by alarm signaling devices, such as those that comply with UL 1971 or other signaling regulations. Upon detecting such a strobe pattern, the system generates an output that is capable of alerting an individual who might not otherwise respond to the alarm condition, such as an individual who is asleep, hearing impaired, and/or sight impaired. The system may, in some embodiments, be constructed as a wearable, battery-operated device. For instance, the device may be configured to be worn on an individual's wrist (in which it may case it may also serve as a wrist watch), or may be incorporated into a patient-worn hearing aid that is configured for insertion into the patient's ear. In other embodiments, the system may, for example, be adapted to be positioned at the bedside, or to be mounted to a fixed structure such as a wall or ceiling.

Figure 1:
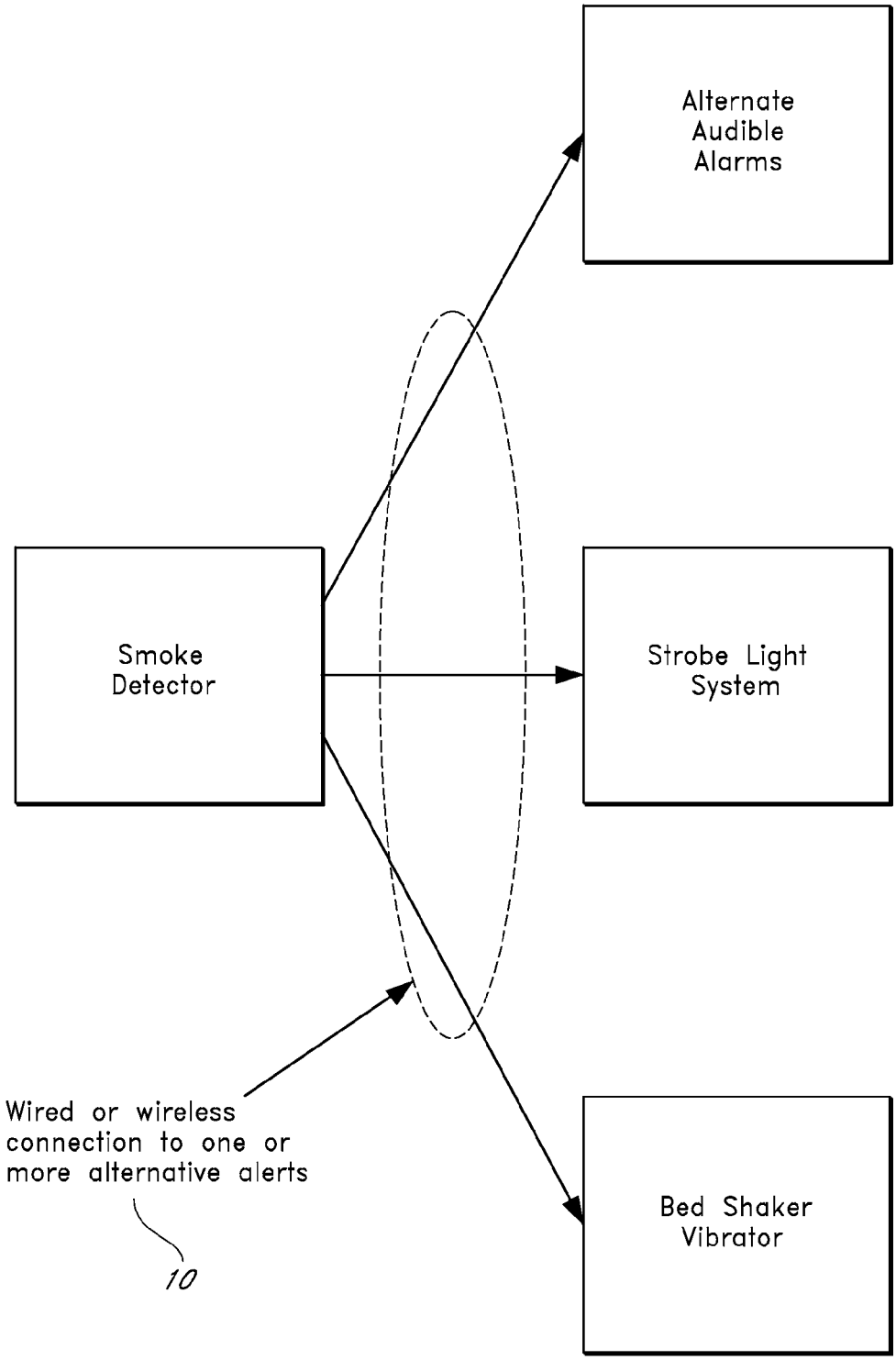
FIG. 1 (Prior Art)
FIGS. 1 and 2 illustrate existing methods and devices for detecting, and alerting users to, various types of alarm signals.
Figure 2:
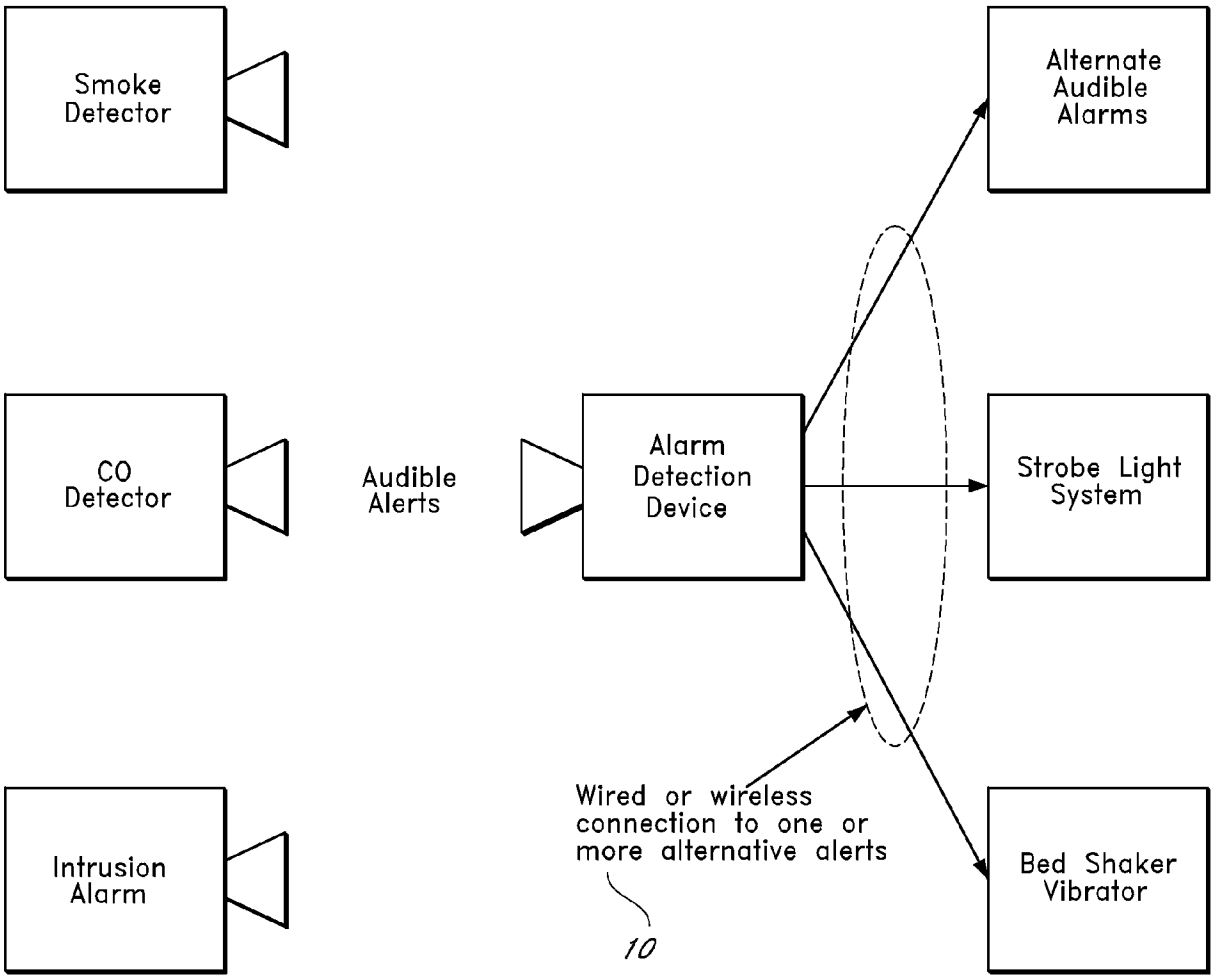
FIG. 2 (Prior Art)
Figure 3:
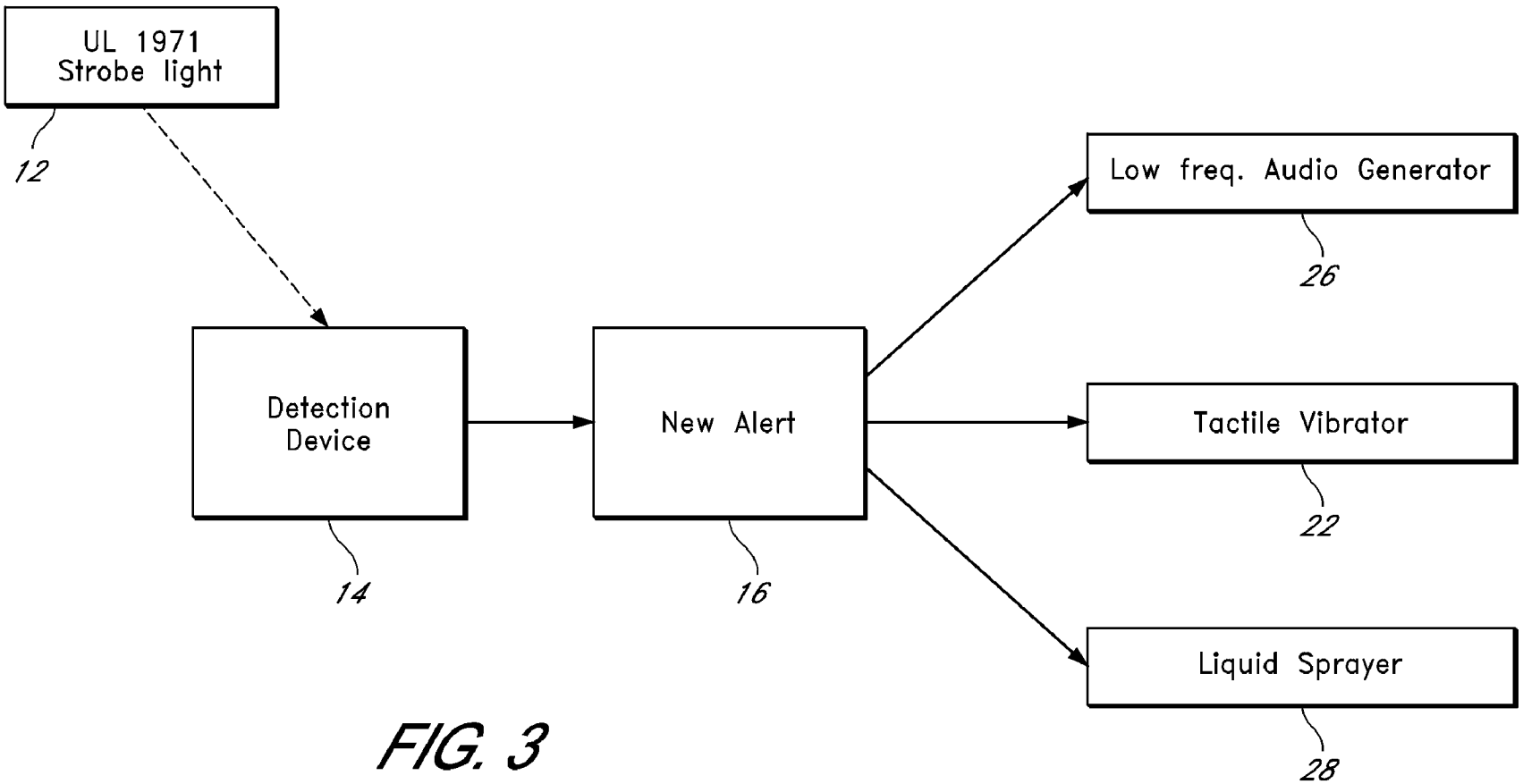
FIG. 3 illustrates the design of an alarm system activated by light signals to alert hearing-impaired individuals of alarm conditions.

FIG. 3 illustrates such an alert system and process in accordance with certain embodiments of the invention. The alert system includes a detection device 14 that uses optical sensing techniques to detect specific strobe light patterns representative of alarm conditions, such as a strobe signal generated by a UL 1971 strobe device 12. The detection device 14 may, for example, include a processor (not shown) that is programmed or designed to assess whether light patterns detected by an optical sensor match the strobe profile of standard alarms. The processor may, for example, be implemented using a microcontroller, a microprocessor, an ASIC (Application Specific Integrated Circuit), or a FPGA (Field Programmable Gate Array), or some combination thereof.

Upon detecting such a strobe condition (depicted as a "new alert" event 16 in FIG. 3), the detection device 14 may be programmed or configured take one or more of the following actions: (1) actuate a vibrator 22 that is part of the wearable device, or which is otherwise physically coupled to the patient (e.g., attached to the patient's bed); (2) actuate an audio generator 26 that outputs a low-frequency audio signal falling in the hearing range (e.g., 100 to 1000 hertz) of many hearing-impaired individuals; (3) actuate a liquid sprayer 28, which may be placed at the patient's bedside. The system may additionally or alternatively be designed to take other types of actions to alert the individual of the alarm condition. For example, in the case of a wrist-worn device, the system could generate a mild shock. As another example, in the case of a hearing aid, the system could output an audible voice message that notifies the patient of the type of alarm condition detected. The alert signal or signals generated by the alert system are referred to herein as supplemental alert signals, as they supplement the alert signal(s) generated by the alarm system. Although multiple forms of supplemental alert signals are depicted, a given system may, in some embodiments, only be capable of generating a single type of supplemental alert signal.

The detection device may also optionally include an audio alarm sensor that is configured to detect audible alarm signals, such as the beep, T-3 and T-4 tone signals generated by home smoke, fire, and CO detectors, and the audible alarm signals generated by UL 217 and 2034 (smoke and CO) compliant devices. Both types of sensors (optical and audio) may be used in combination to assess whether an alarm condition is present. In addition, they may also be combined with wired and wireless signals provided by other sensors and alarm products and systems.

Detection Device

Figure 4:
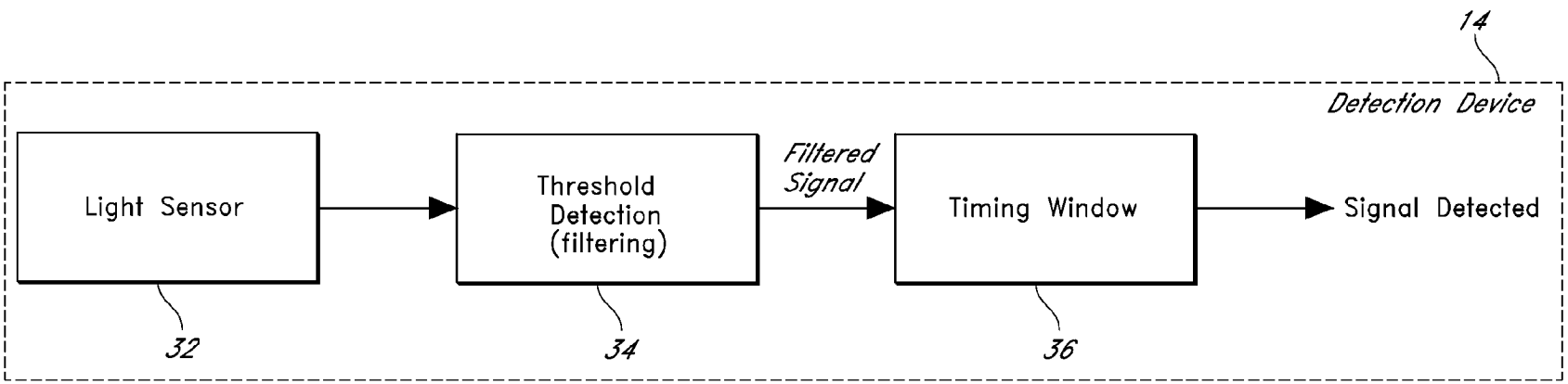
FIG. 4 illustrates the design of a detection device that analyzes light signals and determines whether to activate an alert signal.

In the embodiment exemplified by FIG. 4, the detection device 14 utilizes optical electronics such as phototransistors, photo diodes, photo multipliers, or PIN diodes 32 that convert optical energy (light) into electronic signals reflecting the strength and timing of that light. The electrical signal is separated from background illumination in a threshold or filtering step 34, as illustrated. The filtered signal is analyzed using a timing window 36 (typically over multiple periods) to assess whether it meets the timing criteria of an industry-standard optical alarm signal. For instance, the length of time between successive light pulses may be analyzed to determine whether the light signal has the expected timing frequency of 60 to 120 light pulses per minute. This generally prevents noise or transients that pass the filtering step 34 from being passed along as a signal.

Alternate methods for filtering include the use of optical filters that correspond to the frequencies emitted by strobe lights not dominant in ambient light or electronic components that are similarly tuned to the appropriate optical frequencies.

Figure 5:
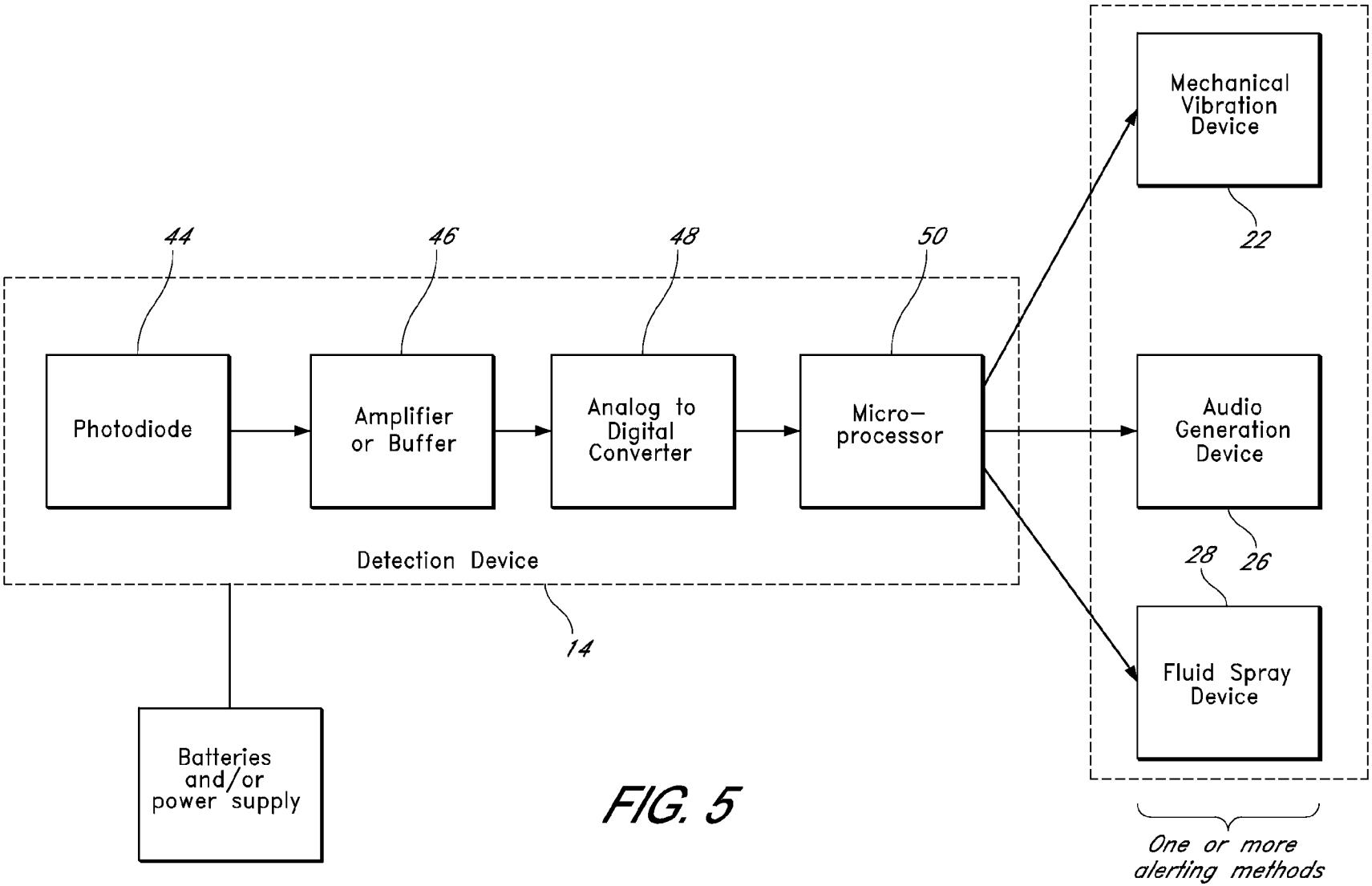
FIG. 5 illustrates the design of an alarm system that includes a detection device that analyzes light signals and one or more alerting methods responsive to an electrical signal produced by the detection device.

The threshold detection step 34 may be performed in either the analog domain (using comparator electronics) or, as illustrated in FIG. 5, in the digital domain using an analog to digital converter 48. In the implementation shown in FIG. 5, some or all of the components can be integrated on a single integrated circuit, providing extremely low component count and very low cost.

FIG. 5 illustrates one example of a set of hardware components that may be used to implement the detection device 14. In the embodiment of FIG. 5, a photodiode 44 converts light energy from a strobe light 12 to an electrical energy. The resulting signal is then amplified and/or stabilized by an amplifier or buffer 46, and is then converted to the digital domain by an analog to digital converter 48. The resulting digital signal is then analyzed by a microprocessor 50 that runs firmware or software that assesses whether the signal provided matches the strobe profile of standard alarms. As mentioned above, various other types of processors may be used to analyze the signal.

The alert system may be implemented using low cost and very low power devices. For example, the alert system may be powered by a small watch battery for over a year, and at a cost and size to easily fit into wrist worn devices such as watches.

In some embodiments, the alert system may include some or all of the components and functionality described in U.S. Pat. No. 7,173,525, titled "Enhanced fire, safety, security and health monitoring and alarm response method, system and device," the disclosure of which is hereby incorporated by reference.

Additional details of several different embodiments of the invention are set forth below.

Wrist Unit

Multiple function wrist worn devices including standard alarm watches are currently available that have features such as light detection and vibration. Examples of this are shown in the following product descriptions:

http://www.epill.com/medicalwatches.html
http://www.nextag.com/vibrating-alarm-watch/search-html
http://www.comforthouse.com/vibalwatdel.html
http://www.212.net/computershop/prod96/timex_pr.htm These types of devices can be augmented with appropriate firmware and/or hardware for implementing the invention.

The wrist-worn device may also be capable of sensing whether the patient has reacted to the supplemental alert signal(s), and for taking an appropriate action based on this determination. For example, the device may include a motion or position sensor (e.g., an accelerometer), and the output of this sensor may be monitored by the device's processor to assess whether the patient is likely aware of the alarm condition. If the patient's movement is deemed insufficient, the alert system may automatically increase the intensity of the audible and/or vibration signal, or may attempt to alert the individual using another method (e.g., an electrical shock).

Stand-Alone Unit

A complete system that implements the current invention can configured for placement at the bed side, or in any other areas or situations where the individuals would not currently be alerted. For example, the invention may be embodied in a battery-powered or AC-powered alarm clock unit, clock radio unit, or telephone unit. This unit may, for example, be capable of generating an audible signal of sufficient volume to wake a hearing-impaired individual. Bedside and proximally located devices can potentially benefit from the ability to alert the individual using low frequency audio methods at significantly lower power levels than devices that would cover an entire room.

This stand-alone unit may include the capability to connect to a monitoring system to alert others of the detected alarms, such as is described in Morales (U.S. Pat. No. 6,215,404), the disclosure of which is hereby incorporated by reference.

As with the patient-worn devices, the stand-alone unit may be capable of sensing whether the patient has reacted to the supplemental alert signal(s), and for taking appropriate action if the patient has not. For instance, the unit may include an infra-red or other motion sensor whose output is programmatically analyzed to assess whether the patient has gotten out of bed in response to the supplemental alarm condition.

A stand-alone unit may also incorporate additional devices and methods to increase waking effectiveness such as bed shakers or vibrators, including those with motion that is continuous, intermittent, or random.

Computer Peripheral Implementations

The present invention can also be implemented using a computer peripheral device such as a USB plug-in module, such as the MSP430 evaluation device by Texas Instruments. Upon detecting the strobe light pattern as described above, the computer peripheral device may interrupt, or otherwise signal, a host computer. The host computer may then activate one or more alert mechanisms, as well as alerting a remote monitoring system and other individuals as described in U.S. Pat. No. 6,215,404, the disclosure of which is hereby incorporated by reference.

Although this invention has been described in terms of certain preferred embodiments and applications, other embodiments and applications that are apparent to those of ordinary skill in the art, including embodiments which do not provide all of the features and advantages set forth herein, are also within the scope of this invention. Accordingly, the scope of the present invention is defined only by the appended claims, which are intended to be interpreted without reference to any explicit or implicit definitions that may be set forth in any incorporated-by-reference materials.

What is claimed is:

1. An alert system, comprising:

a detection device capable of detecting an optical strobe light signal generated by an alarm component in a building; and a supplemental alert signal generator coupled to the detection device, the supplemental alert signal generator being responsive to detection of said optical strobe light signal by generating a supplemental alert signal that is capable of alerting an individual to the presence of an alarm condition, the supplemental alert signal generator being capable of generating at least one of (a) a mild shock to alert the individual, and (b) a low frequency audio alarm signal;

wherein the alert system is configured to be worn on a wrist of the individual.

2. The alert system of claim 1, wherein the supplemental alert signal generator is capable of generating a vibration signal to alert the individual.

3. The alert system of claim 1, wherein the supplemental alert signal generator is capable of generating a mild shock to alert the individual.

4. The alert system of claim 1, wherein the supplemental alert signal generator is capable of generating a low frequency audio alarm signal.

5. The alert system of claim 1, wherein the detection device is further capable of detecting an audible alarm signal, and the supplemental alert signal generator is responsive to detection of said audible alarm signal by generating a supplemental alert signal.

6. An alert system, comprising:

a detection device capable of detecting an optical strobe light signal generated by an alarm component in a building; and a supplemental alert signal generator coupled to the detection device, the supplemental alert signal generator being responsive to detection of said optical strobe light signal by generating a supplemental alert signal that is capable of alerting an individual to the presence of an alarm condition;

wherein the alert system is configured to be worn on a wrist of the individual, and the supplemental alert signal generator is capable of detecting whether the individual has reacted to the supplemental alert signal.

7. The alert system of claim 6, wherein the supplemental alert signal generator is capable of increasing an intensity of the supplemental alert signal in response to detecting an insufficient reaction by the individual to the supplemental alert signal.

8. An alert system, comprising:

a detection device capable of detecting an optical strobe light signal generated by an alarm component in a building; and a supplemental alert signal generator coupled to the detection device, the supplemental alert signal generator being responsive to detection of said optical strobe light signal by generating a supplemental alert signal that is capable of alerting an individual to the presence of an alarm condition;

wherein the supplemental alert signal generator is capable of actuating a liquid sprayer.

9. An alert system, comprising:

a detection device capable of detecting an optical strobe light signal generated by an alarm component in a building; and a supplemental alert signal generator coupled to the detection device, the supplemental alert signal generator being responsive to detection of said optical strobe light signal by generating a supplemental alert signal that is capable of alerting an individual to the presence of an alarm condition;

wherein the alert system is embodied within a hearing aid.

10. An alert system, comprising:

a detection device capable of detecting an optical strobe light signal generated by an alarm component in a building; and a supplemental alert signal generator coupled to the detection device, the supplemental alert signal generator being responsive to detection of said optical strobe light signal by generating a supplemental alert signal that is capable of alerting an individual to the presence of an alarm condition;

wherein the supplemental alert signal generator is capable of generating an audible voice message that indicates a type of alarm condition detected.

11. An alert system, comprising:

a detection device capable of detecting an optical strobe light signal generated by an alarm component in a building; and a supplemental alert signal generator coupled to the detection device, the supplemental alert signal generator being responsive to detection of said optical strobe light signal by generating a supplemental alert signal that is capable of alerting an individual to the presence of an alarm condition;

wherein the detection device is a computer peripheral device that plugs into a port of a personal computer, and the supplemental alert signal generator comprises said personal computer.

12. A method of generating an alert signal, comprising:

converting a light signal into an electrical signal;

analyzing the electrical signal to assess whether the light signal meets criteria of a standard optical alarm signal; and when the light signal meets the criteria of a standard optical alarm signal, generating, or causing the generation of, a supplemental alert signal that is capable of alerting an individual to the presence of an alarm condition;

wherein the method is performed by a wearable hearing aid device.

13. The method of claim 12, wherein analyzing the electrical signal comprises determining whether the signal meets timing criteria of Underwriters Laboratory (UL) code 1971.

14. The method of claim 12, wherein the step of analyzing the electrical signal is performed via software executed by a processor.

15. The method of claim 12, wherein the supplemental alert signal is an audible signal.

16. The method of claim 12, wherein the supplemental alert signal is a vibration signal.

17. A method of generating an alert signal, comprising:

converting a light signal into an electrical signal;

analyzing the electrical signal to assess whether the light signal meets criteria of a standard optical alarm signal; and when the light signal meets the criteria of a standard optical alarm signal, generating, or causing the generation of, a supplemental alert signal that is capable of alerting an individual to the presence of an alarm condition;

wherein the supplemental alert signal comprises an electrical shock applied to the individual.

18. A method of generating an alert signal, comprising:

converting a light signal into an electrical signal;

analyzing the electrical signal to assess whether the light signal meets criteria of a standard optical alarm signal;

when the light signal meets the criteria of a standard optical alarm signal, generating, or causing the generation of, a supplemental alert signal that is capable of alerting an individual to the presence of an alarm condition; and using a signal generated by a motion sensor to automatically assess whether the individual has responded to the supplemental alert signal.

19. An alert system, comprising:

a detection device capable of detecting an optical strobe light signal generated by an alarm component in a building; and a supplemental alert signal generator coupled to the detection device, said supplemental alert signal generator being responsive to detection of said optical strobe light signal by generating a supplemental alert signal that is capable of alerting an individual to the presence of an alarm condition said supplemental alert signal generator being capable of generating a low frequency audio alarm signal;

wherein the detection device and supplemental alert signal generator are part of a stand-alone unit configured for bedside use.

20. The alert system of claim 19, wherein the stand-alone unit is an alarm clock unit.

21. The alert system of claim 19, wherein the stand-alone unit is a clock radio unit.

22. The alert system of claim 19, wherein the stand-alone unit is a telephone unit.

23. The alert system of claim 19, wherein the alert system comprises a motion detector, and is operative to use an output of the motion detector to assess whether a human user of the alert system has responded to the supplemental alert signal.

24. The alert system of claim 19, wherein the supplemental alert signal generator is capable of activating a bed shaker in response to detection of said optical strobe light signal.

25. The alert system of claim 19, wherein the detection device is operative to assess whether detected light patterns match a strobe profile, including an industry-standard strobe timing frequency, used for building alarms.

26. An alert system, comprising:

a detection device capable of detecting an optical strobe light signal generated by an alarm component in a building;

a supplemental alert signal generator coupled to the detection device, said supplemental alert signal generator being responsive to detection of said optical strobe light signal by generating a supplemental alert signal that is capable of alerting an individual to the presence of an alarm condition; and a motion detector;

wherein the detection device and supplemental alert signal generator are part of a stand-alone unit configured for bedside use, and the alert system is operative to use an output of the motion detector to assess whether a human user of the alert system has responded to the supplemental alert signal.

27. The alert system of claim 26, wherein the stand-alone unit is an alarm clock unit.

28. The alert system of claim 26, wherein the stand-alone unit is a clock radio unit.

29. The alert system of claim 26, wherein the stand-alone unit is a telephone unit.

30. The alert system of claim 26, wherein the supplemental alert signal generator is capable of activating a bed shaker in response to detection of said optical strobe light signal.

31. The alert system of claim 26, wherein the detection device is operative to assess whether detected light patterns match a strobe profile, including an industry-standard strobe timing frequency, used for building alarms.

* * * * *